United States Patent [19]

Ackerman

[11] Patent Number: 5,044,013

[45] Date of Patent: Sep. 3, 1991

[54] CREASE RESISTANT INTERLINER AND METHOD OF MAKING THE SAME

[76] Inventor: Myron H. Ackerman, 7209 Promenade Dr., Apt. D-201, Boca Raton, Fla. 33433

[21] Appl. No.: 476,752

[22] Filed: Feb. 8, 1990

[51] Int. Cl.[5] ..... A41D 25/16; A41D 25/00

[52] U.S. Cl. ..... 2/144; 2/146; 2/272; 2/97; 139/426

[58] Field of Search ..... 2/144, 146, 97, 272; 139/426 TW

[56] References Cited

U.S. PATENT DOCUMENTS

| | | | |
|---|---|---|---|
| 887,886 | 5/1908 | Willot | 139/426 TW |
| 889,827 | 6/1908 | Teufel | 139/426 TW |
| 1,436,134 | 11/1922 | Worms | 2/144 |
| 1,677,260 | 7/1928 | Whitman | 139/426 TW |
| 1,756,901 | 4/1930 | Moore | 2/144 |
| 1,822,889 | 9/1931 | Helwith | 139/426 TW |
| 2,049,743 | 8/1936 | Mack | 139/426 TW |
| 2,106,256 | 1/1938 | Rose | 2/144 |
| 2,215,938 | 9/1940 | Schonholzer | 139/426 TW |
| 2,400,182 | 5/1946 | Whitman | 139/426 TW |
| 2,400,276 | 5/1946 | Whitman | 139/426 TW |
| 2,400,379 | 5/1946 | Whitman | 139/426 TW |
| 2,713,360 | 7/1955 | Bloch et al. | 139/426 TW |
| 4,506,389 | 3/1985 | Franklin | 2/144 |
| 4,694,509 | 9/1987 | Grubman | 2/144 |
| 4,839,925 | 6/1989 | Panton, Jr. | 2/144 |

FOREIGN PATENT DOCUMENTS

| | | | |
|---|---|---|---|
| 839778 | 4/1939 | France | 139/426 TW |

*Primary Examiner*—Werner H. Schroeder
*Assistant Examiner*—Gloria Hale
*Attorney, Agent, or Firm*—Kenyon & Kenyon

[57] ABSTRACT

An interliner for a necktie includes a warp having yarns with different twist directions and hardness and a filling having yarns with different twist directions and hardness. Each hard yarn comprises a blend of fibers ranging in denier from about 8 to 15 and has a twist of about 7 to 10 turns per inch. Each soft yarn comprises a blend of fibers ranging in denier from about 3 to about 6 and has a twist of about 4–6 turns per inch. The yarns are sequentially arranged such that the twist direction and hardness sequence in the warp is the same as the twist direction and hardness sequence in the filling. In this way, the interliner provides crease resistance, cupping resistance and stretch control to the tie, while adding to the quality of the "hand" of the tie.

19 Claims, 1 Drawing Sheet

CREASE RESISTANT INTERLINER AND METHOD OF MAKING THE SAME

FIELD OF THE INVENTION

This invention relates to an interliner construction, particularly for a necktie.

BACKGROUND OF THE INVENTION

A necktie should have certain features for appealing to the purchasing public. In addition to exterior colors and design, it should have a certain body and feel, and resist creasing, cupping and other unsightly characteristics when worn.

Conventionally, neckties comprise two basic members, an outer casing and an interliner. As far as the outer casing is concerned, most four-in-hand ties now being made are produced from woven and/or knitted materials that are cut on the bias, although the cutting on the bias is not necessary. These ties are often made in one piece, two piece, or three piece configurations. The one piece construction is in limited use, but is sometimes used to accommodate the width of the outer material employed for the tie. The three piece construction is perhaps the most important and most widely used variety.

Most such ties have a tipping, pocket or facing, which is a piece of material sewn to the back of the tie casing, either on the wide end of the tie or at the narrow end thereof, or both. This is done to give the tie a more luxurious appearance. Any of the three names, tipping, pocket or facing are used to describe this feature.

The interliner portion of the tie is disposed between the outer casing and the tipping to lend support, weight and feel to the tie. The interliner also adds life to the tie by preventing its casing from being unduly distorted or twisted in use. The materials used for the tie interliner usually comprise a woven fabric made from synthetic fibers, or a combination of synthetic and wool fibers, although knitted and non-Woven fabric have also been used to some extent.

It has long been conventional to employ as a tie interliner either a single layer of fabric, which is attached to the inside of the tie and extends from one side thereof to the other, double layers of fabric, or a single layer of fabric with a tape having a width of about one inch secured thereto. The single layer interliners have been used to provide support and weight to the tie. However, these interliners generally do not provide the desired feel. As a result, interliners having a double layer construction were introduced. Examples of double interliners are disclosed in U.S. Pat. No. 3,426,360. These double layer interliners include one layer of lining for support and one layer of lining for feel, with the two layers together providing the requisite weight. Among the drawbacks of the double layer interliners is that they generally are expensive to make. Furthermore, the weight of the interliner must vary in accordance with the weight of the outer casing. Whenever a light outer material is used for a tie, or the tie casing, the tie interliner must be heavier; and conversely, when a heavy material is used for the outer casing, a lighter weight lining should be employed. In recent years, necktie outer casings have been made of lighter material. However, when these light weight outer casings are provided with double interlinings to provide the tie with sufficient support, and the desired weight and feel, the heavy interlining is readily felt through the outer casing made from the lighter material. This detracts from the quality of the "hand" of the tie because one feels the roughness of the interliner instead of the soft texture of the outer casing.

The interliner comprising a single lining with a tape of about one inch width secured thereto also has certain drawbacks. The tape, is used as a relatively inexpensive alternative to add weight to the tie. However, the tape detracts from the feel of the tie and renders the tie susceptible to creasing. Further, it is difficult to slide the knot along the tape.

Further drawbacks of prior art interliners include their inability to resist "cupping". Cupping is the formation of a longitudinal U-shape in the tie when the tie is pulled in the longitudinal direction, i.e., when the tie is placed under tension. Generally, an interliner woven in a conventional manner includes warp and/or filling yarns having a uniform twist direction will not resist cupping.

Finally, the fabric from which the interliners are made is usually cut on the bias so that it will be more resilient, or have more self-contained stretch or elongation in its longitudinal direction, than fabric which is cut straight. However, existing interliner configurations, even if cut along the bias, do not always provide the tie with sufficient stretch resistance to have the tie return to its original length after being pulled in the longitudinal direction.

Therefore, there is a need to provide an interliner construction that prevents cupping, and provides crease resistance, a soft hand and other characteristics desirable to the purchaser. As the interliner can be a significant portion to the cost of a tie, there is also a need to provide these characteristics in an interliner having a single layer construction.

SUMMARY OF THE INVENTION

The present invention relates to an interliner construction suitable for use with a tie that avoids the problems and disadvantages of the prior art. This is accomplished by providing an interliner having an interwoven warp and filling with unique relative characteristics, disposed in an outer casing of a tie. For example, both the warp yarns and the filling include different or varying twist directions in alternating sequence in a manner that provides resistance to cupping and unrecovered elongation when the interliner is placed under tension along its longitudinal axis. This configuration also provides resistance to creasing and wrinkling when the tie is folded or inadvertently crumpled.

Further, the twist sequence in the filling is arranged in the same manner as the twist sequence in the warp. This balances stress in the interliner, thereby providing the interliner with stretch control and memory. The stretch control ensures that the interliner will stretch evenly in all directions, while the memory ensures that the interliner, and thus the tie, returns to its original flat shape without cup, curl or twist when stress applied to the interliner is removed. Generally, interliner fabric must be cut on the bias, i.e., 45 degrees to the warp, to provide stretch control. The foregoing interliner construction provides the interliner fabric with a cutting tolerance of $\pm 10$ degrees from the bias without reducing stretch control. This permits use of uncut interliners of different widths to be used, thereby reducing inventory costs.

Another feature of the invention concerns the hardness of the yarns. Yarn having harder characteristics exhibits increased crease resistance, but can detract from the quality of the "hand" of the tie. The present invention optimizes crease resistance and the quality of the hand of the tie by using both hard and soft yarns. To vary the hardness of the yarn, the degree of twist in different yarns and the fineness or denier of yarn fibers in different yarns is varied in certain alternating sequence.

The above is a brief description of some deficiencies in the prior art and advantages of the present invention. Other features, advantages and embodiments will be apparent to those skilled in the art from the following description, accompanying drawings and appended claims.

BRIEF DESCRIPTION OF THE DRAWINGS

FIG. 2 illustrates the twist directions of yarn wherein:

DETAILED DESCRIPTION

Figure 1:
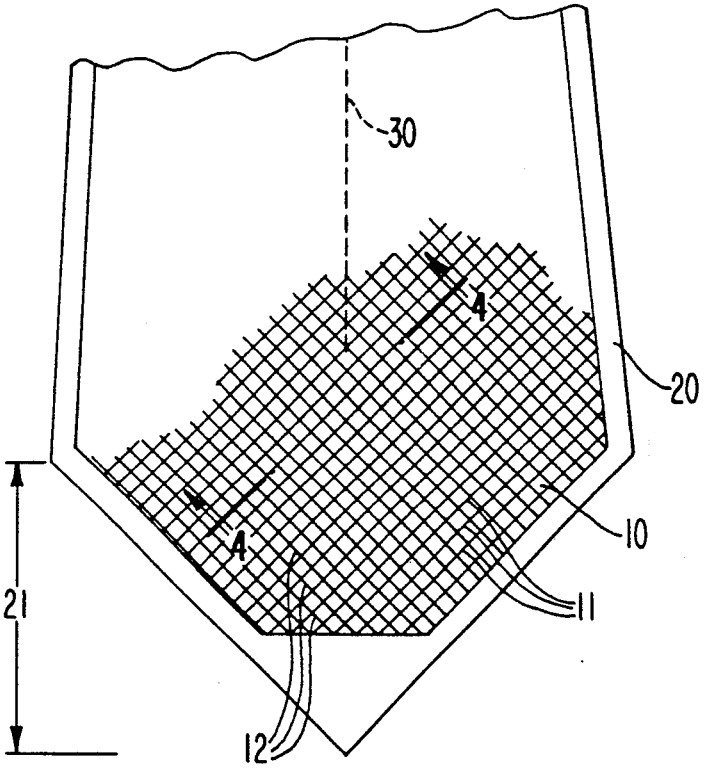
FIG. 1 is a top plan view of the interliner in accordance with the principles of the invention.

Referring to the drawings in detail wherein like numerals indicate like elements, FIG. 1 shows interliner 10 coupled to outer casing 20 by stitching 30. Interliner 10, which can run forty to sixty inches in length (the length of the tie), includes warp yarns 11 and filling yarns 12 which are interwoven in a generally conventional manner. Although shown as extending almost to the end of the tie, interliner 10 need not extend to that extent, e.g., interliner 10 can be squared off to end before tapered portion 21 of outer casing 20.

It should also be noted that interliner 10 is cut at about a 45 degree bias. That is both the warp and the filler extend at about a 45 degree angle to the longitudinal axis of the tie as shown in FIG. 1. Although the angle of the bias cut could be employed at other angles, the 45 degree angle is preferred and yields the greatest balance. Other parameters being relatively equal, the interliner and ultimately the tie will not be easily pulled out of its natural shape or otherwise distorted. Regardless of the direction of strain imposed on the tie, because of the balance effected by the bias cut, the interliner will tend to retract to its normal position.

Figure 3:
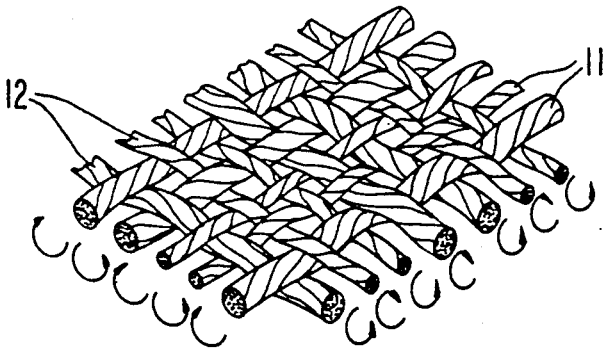
FIG. 3 is a perspective view of a portion of the fabric of the interliner illustrating varied yarn twist directions and varied fiber fineness.

The interliner fabric is woven in a conventional manner and cut on about a 45 degree bias. As can be seen in FIG. 3, this produces a fabric where the warp yarns and the filling yarns extend at a right angle to each other. If the fabric wa subject to a straight cut it would be cut along a line parallel to the warp, cutting all the filling yarns without cutting the warp, or vice versa. A 45 degree angle bias cut means that all of the filling and the warp is cut at about a 45 degree angle to the direction of the woven yarns.

The interliner is dimensioned to be almost coextensive with the tie casing, leaving only a very small margin between the edge of the interliner and the edge of the casing. This permits the interliner to provide the desired body throughout substantially the entire extent of the tie.

In this invention, a unique arrangement and configuration of warp and filling yarn has been achieved. By utilizing certain parameters of the yarn such as size, twist, hardness, softness, fineness and the type of fiber, the interliner can be manufactured with enhanced body and feel and in an economical manner.

Figure 2A:
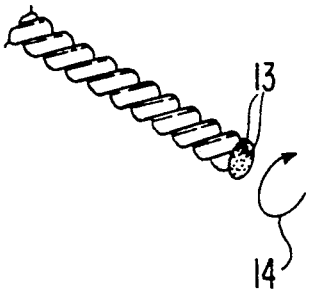
FIG. 2A shows yarn twist in a first direction.
Figure 2B:
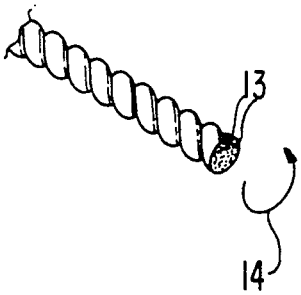
FIG. 2B shows yarn twist in a second opposite direction.

Referring to FIGS. 2A and 2B yarns 11 and 12 comprise fibers 13 and have either a clockwise twist direction, i.e., a right twist (FIG. 2A), or a counterclockwise twist direction, i.e., a left twist (FIG. 2B), designated by arrows 14 and 15, respectively. To balance the stress in interliner 10 and thus provide crease and cupping resistance as well as stretch control thereto, the twist direction of the warp yarns is varied and the twist direction of the filling yarns is varied. Further, the twist direction sequence in the warp should match the twist direction sequence in the filling to completely balance the interliner as illustrated in FIG. 3. Although the twist direction can alternate, as shown in FIG. 3, other twist sequences can be used that balance the stresses in the interliner such that the stresses in the interliner are at equilibrium When the interliner is flat. For example, the warp can comprise alternating groups of two left twist yarns and two right twist yarns, i.e., left left, right right, left left. Although this sequence balances the warp, the filling should comprise yarns arranged in the same manner. to balance the stresses in the interliner as a whole. Obviously, other sequences also can be used for the warp and filling, such as alternating groups of three left twist yarns and three right twist yarns, and so forth.

The crease resistance also is affected by the hardness of the yarns. Particularly, when the interliner is balanced, as described above, its crease resistance can be increased by increasing the hardness of its component yarns. The hardness of the yarn is attributed to the degree of twist and/or the fineness or denier of the fiber. For example, a higher degree of twist increases the hardness of the yarn. The higher degree of twist provides a corresponding higher degree of energy that is stored in the yarn. That increase in energy increases the resilience of the yarn and the crease resistance of the interliner.

Although the use of relatively hard yarns throughout the interliner would greatly enhance its crease resistance, the resultant relatively hard interliner would detract from the "hand" or feel of the tie. Accordingly, the hardness of the yarns in the warp as well as the hardness of the yarns in the filling is varied. For example, the warp and filling can comprise alternating hard and soft yarns, alternating groups of two hard yarns and two soft yarns, alternating groups of three hard yarns and three soft yarns, and so forth. In this way the interliner not only resists creasing, it can add to the "hand" of the tie.

Figure 4:
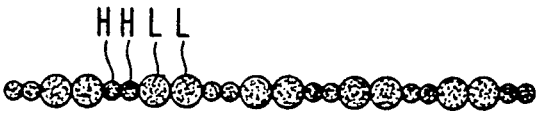
FIG. 4 is a sectional view of the interliner fabric taken along lines 4—4 of FIG. 1.

FIG. 4 illustrates yarns having varying degrees of twist, and thus varying degrees of hardness. Yarns L have a low degree of twist and thus are relatively soft, while yarns H have a high degree of twist and are relatively hard. Thus, FIG. 4 illustrates an embodiment comprising alternating groups of two hard yarns and two soft yarns.

Further, the degree of twist is related to denier. Generally, a high degree of twist is used with a very course fiber, while a low degree of twist is used with a very fine fiber. To form a hard yarn, i.e., a yarn with high crease resistance, a blend of fibers, ranging in denier from about 8 to about 15, are bundled to form the yarn which is then given a twist of about 7–10 turns per inch. In contrast, to form a bulkier, softer yarn, a blend of fibers, ranging in denier from about 3 to about 6, are bundled to form the yarn which is then given a twist of about 4–6 turns per inch.

Merely to exemplify a preferred makeup of the interliner, the following example may be recited:

| Material | Twist Direction | Hardness | Fiber Denier | Turns Per Inch |
|---|---|---|---|---|
| | WARP YARN SEQUENCE | | | |
| Polyester | Right | Hard | 8–15 | 9 |
| Polyester | Right | Soft | 3–6 | 5 |
| Polyester | Left | Hard | 8–15 | 9 |
| Polyester | Left | Soft | 3–6 | 5 |
| Polyester | Right | Hard | 8–15 | 9 |
| Polyester | Right | Soft | 3–6 | 5 |
| | FILLING YARN SEQUENCE | | | |
| Polyester | Right | Hard | 8–15 | 9 |
| Polyester | Right | Soft | 3–6 | 5 |
| Polyester | Left | Hard | 8–15 | 9 |
| Polyester | Left | Soft | 3–6 | 5 |
| Polyester | Right | Hard | 8–15 | 9 |
| Polyester | Right | Soft | 3–6 | 5 |

Other embodiments which provide satisfactory results include the following:

| Material | Twist Direction | Hardness | Fiber Denier | Turns Per Inch |
|---|---|---|---|---|
| | Example 1 | | | |
| | WARP YARN SEQUENCE | | | |
| Polyester | Right | Hard | 8–15 | 9 |
| Polyester | Right | Hard | 8–15 | 9 |
| Polyester | Left | Soft | 3–6 | 5 |
| Polyester | Left | Soft | 3–6 | 5 |
| Polyester | Right | Hard | 8–15 | 9 |
| Polyester | Right | Hard | 8–15 | 9 |
| | FILLING YARN SEQUENCE | | | |
| Polyester | Right | Hard | 8–15 | 9 |
| Polyester | Right | Hard | 8–15 | 9 |
| Polyester | Left | Soft | 3–6 | 5 |
| Polyester | Left | Soft | 3–6 | 5 |
| Polyester | Right | Hard | 8–15 | 9 |
| Polyester | Right | Hard | 8–15 | 9 |
| | Example 2 | | | |
| | WARP YARN SEQUENCE | | | |
| Polyester | Right | Hard | 8–15 | 9 |
| Polyester | Left | Soft | 3–6 | 5 |
| Polyester | Right | Hard | 8–15 | 9 |
| Polyester | Left | Soft | 3–6 | 5 |
| Polyester | Right | Hard | 8–15 | 9 |
| Polyester | Left | Soft | 3–6 | 5 |
| | FILLING YARN SEQUENCE | | | |
| Polyester | Right | Hard | 8–15 | 9 |
| Polyester | Left | Soft | 3–6 | 5 |
| Polyester | Right | Hard | 8–15 | 9 |
| Polyester | Left | Soft | 3–6 | 5 |
| Polyester | Right | Hard | 8–15 | 9 |
| Polyester | Left | Soft | 3–6 | 5 |

The method of making the interliner comprises the steps of providing a warp comprising yarns that vary in twist direction and hardness; weaving filling yarns into the warp such that the filling yarns also vary in twist direction and hardness, wherein the twist direction and hardness sequence in the filling is arranged in the same manner as in the warp; and cutting the interwoven warp and filling on the bias to form lengths of fabric having a width suitable for coupling to the interior of the outer casing of a necktie in a conventional manner. For example, the warp can be provided with alternating groups of two left twist yarns and two right twist yarns. In addition to the above twist sequence, the warp can include alternating hard and soft yarns. Thus, according to this example, the warp yarn sequence would be Right-Hard, Right-Soft, Left-Hard, Left-Soft, Right-Hard, Right-Soft, and so forth. The filling would have the same sequence. As explained above, each hard yarn comprises a blend of fibers ranging in denier from about 8 to 15, while each soft yarn comprises a blend of fiber ranging in denier from about 3 to 6. Further, the hard and soft yarns are given a twist of, for example, about 9 and 5 turns per inch, respectively.

Having described the invention in detail, it will be recognized that the foregoing is considered as illustrative only of the principles of the invention. Since numerous modifications and changes will readily occur to those skilled in the art, it is not desired to limit the invention to the exact construction, materials, assembly and so forth shown and described. Accordingly, all suitable modifications and equivalents may be resorted to the extent they fall within the scope of the invention and the claims appended hereto.

What is claimed:

1. A necktie comprising:

an outer casing; and an interliner disposed in said outer casing, said interliner comprising a warp and a filling that are interwoven, said warp including hard and soft yarns and said filling including hard and soft yarns, each hard yarn comprising a blend of fibers ranging in denier from about 8 to 15 and having a twist of about 7 to 10 turns per inch, each soft yarn comprising a blend of fibers ranging in denier from about 3 to 6 and having a twist of about 4 to 6 turns per inch.

2. The necktie of claim 1 wherein said warp yarns that are relatively hard have a twist of about 9 turns per inch, said warp yarns that are relatively soft have a twist of about 5 turns per inch.

3. The necktie of claim 2 wherein said filling yarns that are relatively hard have a twist of about 9 turns per inch, said filling yarns that are relatively soft have a twist of about 5 turns per inch.

4. The necktie of claim 3 wherein said warp and filling yarns are sequentially arranged such that said warp comprises alternating hard and soft yarns and said filling comprises alternating hard and soft yarns.

5. The necktie of claim 1 wherein said warp and filling yarns are sequentially arranged such that said warp comprises alternating hard and soft yarns and said filling comprises alternating hard and soft yarns.

6. An interliner for a necktie, said interliner comprising:

a warp including yarns having different twist directions and hardness, said yarns having different hardness including hard and soft yarns, each hard yarn comprising a blend of fibers ranging in denier from about 8 to 15 denier and having a twist of about 7 to 10 turns per inch, each soft yarn comprising a blend of fibers ranging in denier from about 3 to 6 denier and having a twist of about 4 to 6 turns per inch; and a filling including yarns having different twist directions and hardness, said yarns having different hardness including hard and soft yarns, each hard yarn in the filling comprising a blend of fibers ranging in denier from about 8 to 15 denier and having a twist of about 7 to 10 turns per inch, each soft yarn in the filling comprising a blend of fibers ranging in denier from about 3 to 6 denier and having a twist of about 4 to 6 turns per inch.

7. The interliner of claim 6 wherein said warp and filling are interwoven, and said interwoven warp and filling is cut on the bias.

8. The interliner of claim 6 wherein said yarns are sequentially arranged such that the twist direction and hardness sequence in said warp is the same as the twist direction and hardness sequence in said filling.

9. The interliner of claim 8 wherein said warp yarns are arranged sequentially in pairs of like twist direction with alternating pairs having different twist directions.

10. The interliner of claim 9 wherein said yarns that are relatively hard have a twist of about 9 turns per inch, said yarns that are relatively soft have a twist of about 5 turns per inch.

11. The interliner of claim 9 wherein said warp and filling yarns are sequentially arranged such that said warp comprises alternating hard and soft yarns and said filling comprises alternating hard and soft yarns.

12. The interliner of claim 7 wherein said warp and filling yarns are sequentially arranged such that said warp comprises alternating hard and soft yarns and said filling comprises alternating hard and soft yarns.

13. A method of making an interliner comprising of steps of:

providing a warp comprising yarns that vary in twist direction and hardness;

weaving filling yarns into the warp such that the filling yarns also vary in twist direction and hardness, wherein the twist direction and hardness sequence in the filling is arranged in the same manner as in the warp; and cutting the interwoven warp and filling on the bias to form lengths of interliner fabric having a width suitable for coupling to the interior of the outer casing of a necktie.

14. The method of claim 13 including stitching the interliner to the interior of the outer casing of the necktie.

15. The method of claim 13 including providing the warp with alternating groups of two left twist yarns and two right twist yarns.

16. The method of claim 15 including providing the warp with alternating hard and soft yarns.

17. The method of claim 16 including providing the hard yarns with a twist of about 9 turns per inch and the soft yarns with a twist of about 5 turns per inch.

18. The method of claim 17 including providing each hard yarn with a blend of fibers ranging in denier from about 8 to 15 denier and each soft yarn with a blend of fibers ranging in denier from about 3 to 6 denier.

19. The method of claim 13 including providing the warp with alternating hard and soft yarns.

* * * * *